US010010168B1

(12) United States Patent
Flanagan

(10) Patent No.: US 10,010,168 B1
(45) Date of Patent: Jul. 3, 2018

(54) PIVOTING WRITING TABLET

(71) Applicant: WORCESTER MANUFACTURING, INC., Worcester, MA (US)

(72) Inventor: Charles D. Flanagan, Worcester, MA (US)

(73) Assignee: Worcester Manufacturing, Inc., Worcester, MA (US)

( * ) Notice: Subject to any disclaimer, the term of this patent is extended or adjusted under 35 U.S.C. 154(b) by 0 days.

(21) Appl. No.: 15/438,882

(22) Filed: Feb. 22, 2017

(51) Int. Cl.
*A47B 5/04* (2006.01)
*A47C 7/70* (2006.01)

(52) U.S. Cl.
CPC . *A47B 5/04* (2013.01); *A47C 7/70* (2013.01)

(58) Field of Classification Search
CPC ..... A47B 5/04; A47C 7/70
USPC ..... 297/170, 172, 173, 155, 344.21, 344.22; 108/94, 139
See application file for complete search history.

(56) References Cited

U.S. PATENT DOCUMENTS 314,181 A * 3/1885 Hyde ..... A47B 23/042 248/454
564,044 A * 7/1896 Berkemeyer ..... A47B 83/02 297/170
646,835 A * 4/1900 Jackson ..... A47B 23/02 248/231.71
3,266,840 A * 8/1966 D Estrube ..... A47B 83/02 108/147.2
3,601,443 A * 8/1971 Jones ..... A47C 1/11 108/103
4,136,908 A * 1/1979 Crayne ..... A47C 1/11 297/188.21
5,169,210 A * 12/1992 Fricano ..... A47C 7/70 248/282.1
6,142,559 A * 11/2000 Sorel ..... A47C 7/70 108/48
6,422,646 B1 * 7/2002 McNally ..... A47C 7/70 297/149
6,669,282 B2 * 12/2003 Piretti ..... A47C 3/04 297/162
6,776,452 B2 * 8/2004 Onishi ..... A47B 83/02 108/143
8,696,056 B2 4/2014 Corcorran et al.
9,044,099 B2 6/2015 Bouche
9,693,625 B2 * 7/2017 Lu ..... A47B 83/02

* cited by examiner

*Primary Examiner* — Jose V Chen
(74) *Attorney, Agent, or Firm* — Chapin IP Law, LLC

(57) ABSTRACT

A pivoting tablet on a swivel arm rotating around a seating unit such as a student chair provides a writing or utility surface proximate to a seated occupant that allows the tablet to be pivoted to a comfortable and effective writing position such that the swivel arm allows rotation of the tablet support to enter and exit the chair and allows positioning based on the dominant hand of the occupant. The tablet pivots around a bore in a sleeve attached to an end of the swivel arm, into which a shaft having a protrusion extends. The protrusion engages an annular slot in the sleeve for guiding and limiting pivotal movement. The seat rests on a pedestal defined by a plurality of legs surrounding a rack or platform for books. The pedestal has a column supporting the seat surface, and a collar around the column allows rotation of the swivel arm holding the tablet.

15 Claims, 8 Drawing Sheets

PIVOTING WRITING TABLET

BACKGROUND

Student desk chairs are appliances that combine a seating apparatus with a working surface and a storage area for facilitating students having a plurality of books and/or backpacks, bags and academic media. Previous configurations of desk chairs employed fixed surfaces for providing a desk region. Occupant entry and exit can be hindered by the fixed desk surface. More modern approaches employ a moveable tablet or working surface to facilitate seat entry and exit. However, the stability of the desk chair can be compromised by extreme movement ranges of the working surface. Also, the mechanism for providing working surface movement is prone to substantial force from use. Also, as such desk chairs are often purchased in volume to accommodate a student body, per unit cost tends to be scrutinized.

SUMMARY

A pivoting tablet on a swivel arm rotating around a seating unit such as a student chair provides a tablet support for a writing or utility surface proximate to a seated occupant that allows the tablet to be pivoted to a comfortable and effective writing position and the swivel arm allows rotation of the tablet support to enter and exit the chair and allows positioning based on the dominant hand of the occupant. The tablet pivots around a bore in a sleeve attached to an end of the swivel arm, into which a shaft having a protrusion extends. The protrusion engages an annular slot in the sleeve for guiding and limiting pivotal movement. The seat rests on a pedestal defined by a plurality of legs surrounding a rack or platform for books. The pedestal has a column supporting the seat surface, mounted on bearings so as to permit independent rotation and a collar around the column allows rotation of the swivel arm holding the tablet.

In a particular configuration, the pivoting tablet further comprises a seating unit with a writing tablet, said tablet supported by an arm free to rotate around a central support shaft, said tablet having a support structure incorporating a cylindrical bushing or sleeve having an arcuate slot, said bushing surrounding a shaft incorporated in and extending from a distal end of the support arm and having a radial projection extending into the arcuate slot so as to limit rotation of the writing tablet around the support arm.

In the disclosed approach, the protrusion may be defined by a roll pin or spring pin inserted into an aperture in the shaft. The roll pin is constructed of a planar material rolled into a cylindrical shape, and may have a chamfered or tapered end for facilitating insertion. The roll pin has a diameter slightly larger than the aperture when the roll pin is in an uncompressed state, and has a longitudinal groove or gap for allowing compression of closure of the gap to reduce the diameter sufficient for insertion into the aperture. Biasing forces in the roll pin tending toward the larger diameter serve to frictionally engage the roll pin in the aperture.

The disclosed student desk chair arrangement as depicted therefore defines a moveable desk surface appliance having a tablet on a pivoting support, and a shaft fixedly attached to the pivoting support, in which the shaft has a protrusion extending radially from an axis of the shaft. A swivel arm includes a sleeve having a bore adapted to receive the shaft for rotation therein, and an annular slot in the sleeve is configured to engage the protrusion, such that the annular slot has end walls for limiting movement of the shaft. The swivel arm attaches to the sleeve at a distal end, and the swivel arm is adapted for rotational movement relative to an attached pedestal base at a proximate end to the seat of the desk chair.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
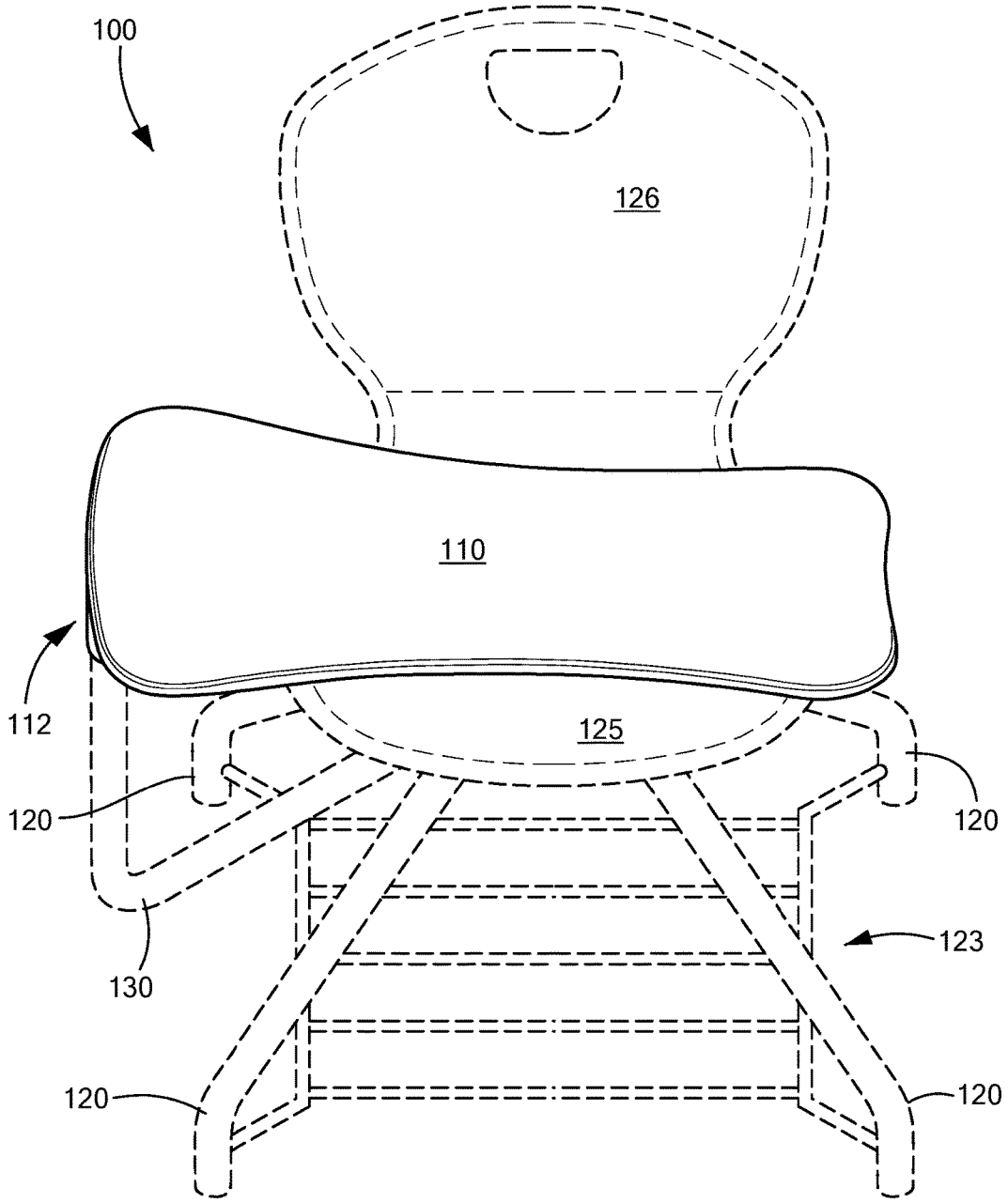
FIG. 1 is a front or perspective view of a desk chair suitable for use with configurations herein.

Configurations below depict an example desk chair and tablet configuration embodying the disclosed approach. In the student desk chair, a writing surface depicted by a tablet pivots around the seating surface of the chair to allow entry and exit, and to allow the seated occupant to position the tablet for optimal ergonomic comfort and also for either dominant hand. The tablet pivots within a range of movement to permit comfort and function while restricting unstable positions that could occur as the tablet swings outward in a cantilever manner with respect to the chair.

In a particular configuration, the disclosed pivot linkage includes a roll pin which is inserted into an arcuate, annular slot cut into a vertical support tube and into a concentric circular shaft supporting the table for rotational movement within the tube. The rotation of the circular shaft, and hence of the supported tablet, are constrained by the roll pin engaging edges of the arcuate slot, such that the arcuate slot defines the range of tablet rotation.

A conventional approach is disclosed in U.S. Pat. No. 8,696,056, entitled "SEATING UNIT." In the '056 patent, a projection 80 extends upward from pivoting table support through a top annular flange 68 adjacent to bent edges 74,76 on a rib 72. The bent edges engage stop edges 62 and 64 formed by a depression 60 in the connecting portion 56 extending downward from the tablet. The rib 72 and bent edges 74, 76 limit rotation extend upward from the second end 26 of the support arm 20, and not out from the circular shaft as does the roll pin. The complementary surface engaging the bent edges 74, 76 in the '056 approach are the stop edges 62 and 64, which are formed integrally with the tablet mount connecting portion 56, in contrast to the engaged edges of the arcuate slot in the disclosed approach. The use of an inserted roll pin allows the circular shaft and vertical support tube to engage on a flat, horizontal plane, instead of an irregular system of cutouts, edges and stops.

Another conventional approach is shown by U.S. Pat. No. 9,044,099, entitled "CHAIR WITH ADJUSTABLE TABLET." In the '099 approach, outer ends 108 of the flange 95 extending upward from the pivot limiting sleeve 94 engage ends 110 of the pivot channel 112. The flange 95 extends upward from a support post and into the pivot channel 112 in a tablet support bracket 30, 32 which is driven from the tablet movement. As in the '056 patent, the flange 95 extends parallel to an axis of tablet rotation. The pivot channel 112 is cut to open downward and parallel to, not radially outward and perpendicular to, the tablet rotation axis.

The conventional approaches employ irregular shapes that require substantial molding or machining, increasing cost and complexity. The disclosed shaft and protrusion engaging a slot is defined by operations performable with simply circular and linear manipulations, i.e. drills and blades.

FIG. 1 is a front or perspective view of a desk chair 100 suitable for use with configurations herein. Referring to FIG. 1, a moveable desk surface appliance or desk chair 100, include a tablet 110 on a pivoting support 112 supporting a tablet frame. The desk chair 100 includes 4 or more legs 120, and optionally casters or rollers. A rack 122 helps secure the legs 120 and also provides a storage area for books, bags and related materials. A seating surface 125 accommodates an occupant, and a back surface 126 enhances support. A swivel arm 130 extends from beneath and rotates around the seating surface 125 at a proximate end, and pivotally attaches to the tablet 110 at a distal end, as described further below.

Figure 2:
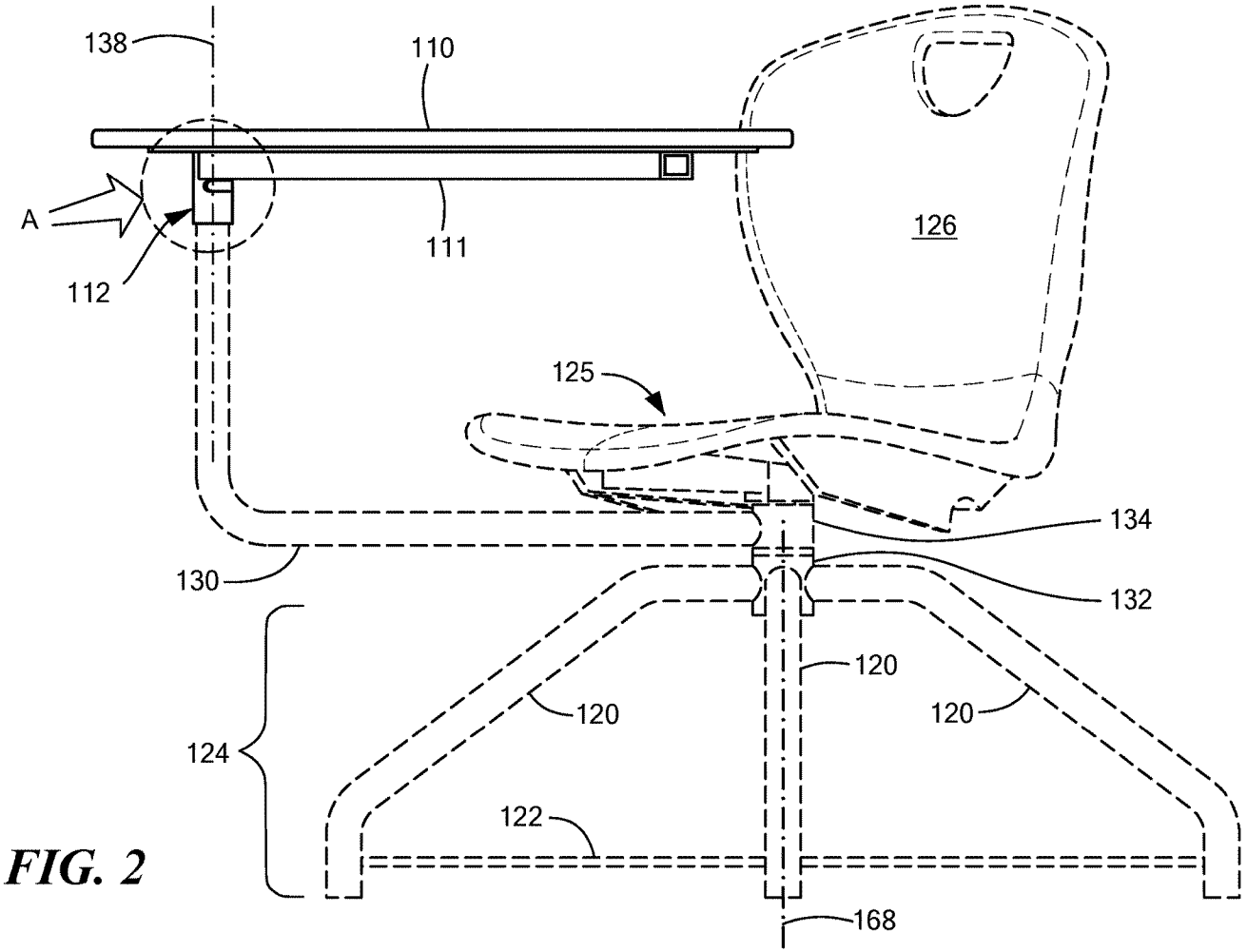
FIG. 2 is a side view showing the pivoting support of the desk chair of FIG. 1.

FIG. 2 is a side view showing the pivoting support of the desk chair of FIG. 1. In FIG. 2, the legs 120 and rack 122 define a pedestal base 124 supporting a pedestal column 132. A collar 134 rotates on the pedestal column 132 and attaches to the swivel arm 130. A shaft axis 138 defines a pivot of the tablet 110, and a swivel axis 168 defines swivel rotational movement of the swivel arm 130 around the pedestal column 132.

Figure 2A:
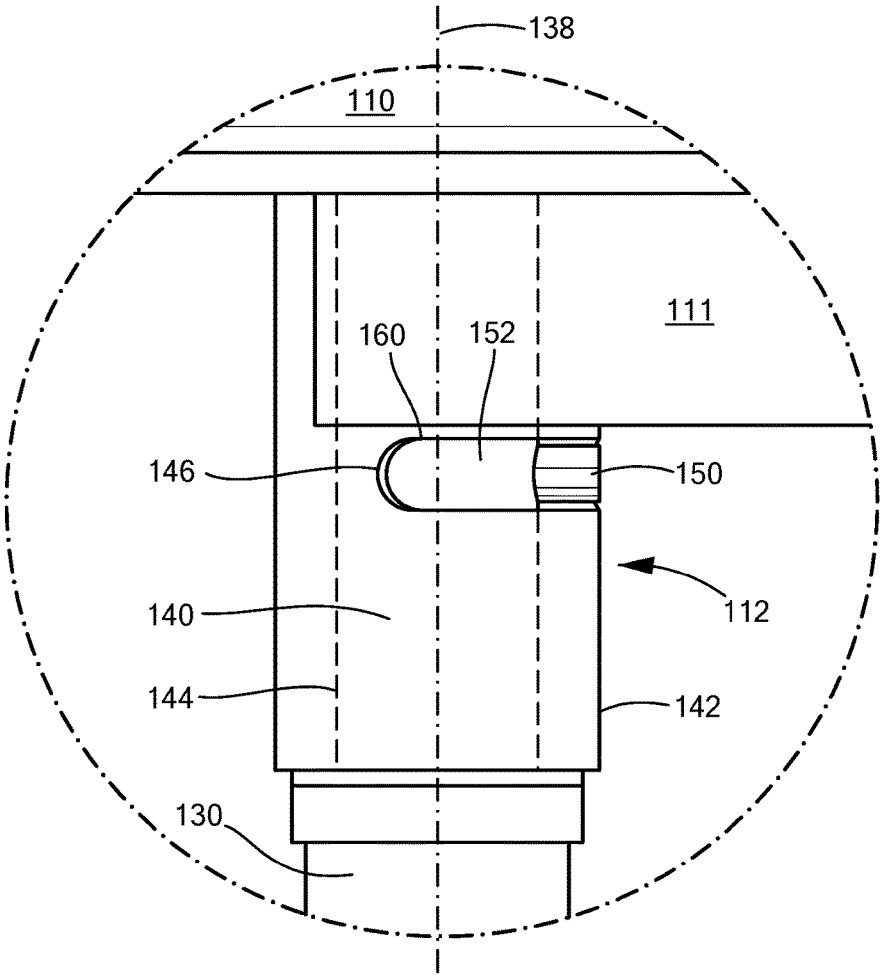
FIG. 2A shows an expanded view of the pivoting support of FIG. 2.

FIG. 2A shows an expanded view of the pivoting support 112 of FIG. 2. Referring to FIG. 2A, a shaft 140 fixedly attaches to the pivoting support and tablet frame 111. The shaft 140 has a protrusion 150 extending radially from the axis 138 of the shaft 140. A sleeve 142 has a bore 144 adapted to receive the shaft 140 for rotation therein. An annular slot 152 in the sleeve 142 is configured to engage the protrusion 150, such that the annular slot has end walls 146 for limiting movement of the shaft 140. The swivel arm 130 attaches to the sleeve 142, in which the swivel arm 130 is also adapted for rotational movement relative to the attached pedestal base 124, discussed further below.

Figure 3A:
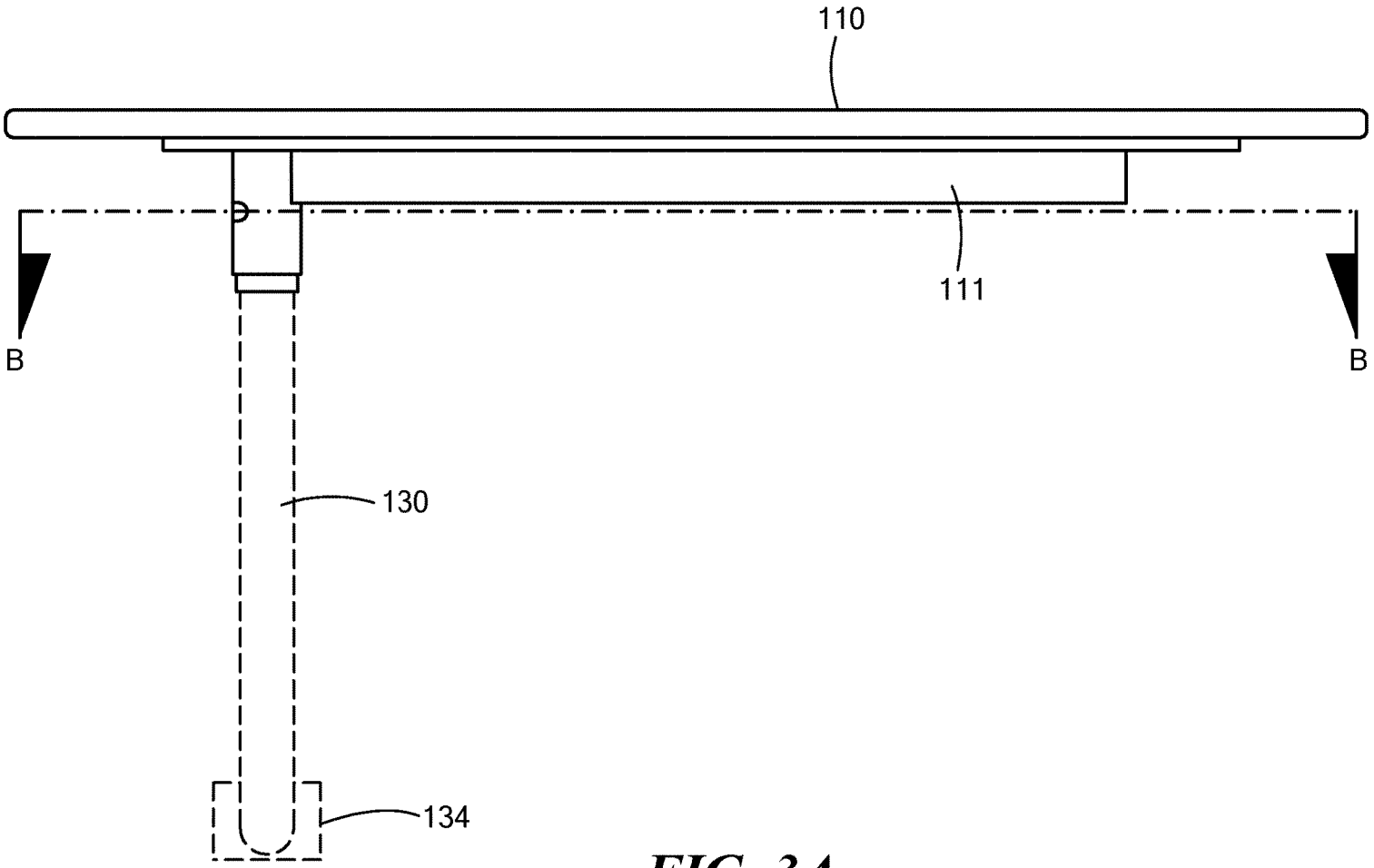
FIG. 3A shows a side view of the tablet of the desk chair of FIG. 1.
Figure 3C:
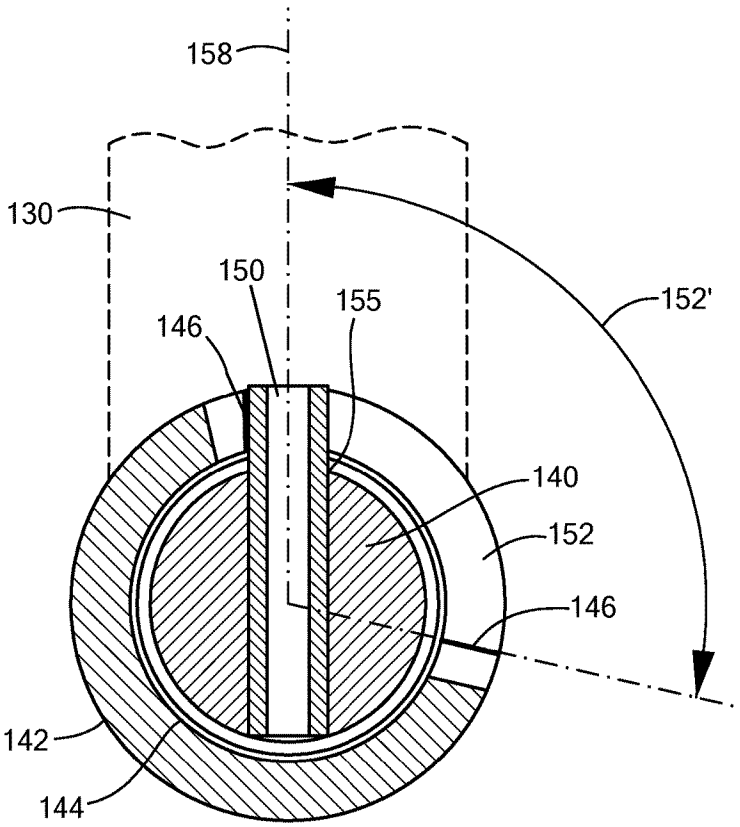
FIG. 3C shows a detail section of the circled area denoted C in FIG. 3B.
Figure 3B:
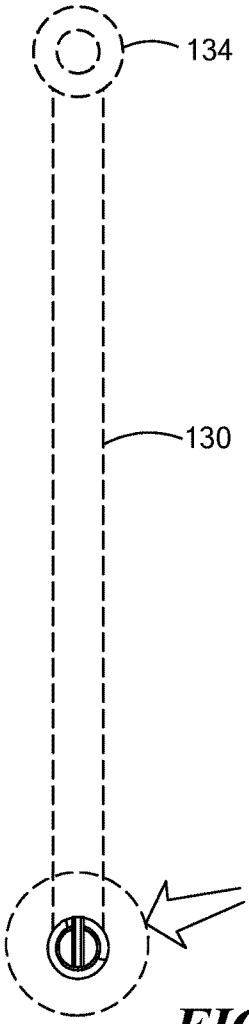
FIG. 3B shows a cross section of FIG. 3A along the line denoted B.

FIG. 3A shows a side view of the tablet of the desk chair of FIG. 1, and FIG. 3B shows a cross section of FIG. 3A along the line denoted B. FIG. 3C shows a detail section of the circled area denoted C in FIG. 3B. Referring to FIGS. 2, 2A and 3A-3C, the annular slot 152 defines an arcuate region 152' of the sleeve 142 adapted to engage the protrusion 152 for limiting pivotal movement of the shaft 142, and hence the tablet 110. The protrusion 150 extends radially from and perpendicular to the shaft axis 138 along an insertion axis 158, such that the shaft axis 138 defines pivotal movement of the tablet 110. The annular slot has opposed end surfaces or end walls 146 for defining the arcuate region 152'. The protrusion 150 travels in the slot 152 as the shaft rotates with the tablet. Upon reaching an end of the arcuate region 152', pivotal movement is limited by interference of the protrusion 150 with the end surfaces 146 as the protrusion contacts the end surfaces 146 but maintains sufficient shear force resistance to stop shaft 140 rotation.

Continuing to refer to FIGS. 2A and 3C, the annular slot 152 has guide surfaces 160 along a longer dimension of the annular slot 152, such that the guide surfaces 160 are configured for slideable engagement of the protrusion 150 during pivoting of the shaft 140. The protrusion 150 has a diameter slightly smaller than the width of the annular slot 152 for slideable travel therewithin.

The protrusion 150 is therefore configured to secure the shaft 140 in rotational communication with the sleeve 142 from interference with the guide surfaces. As the shaft 140 rotates in the sleeve 142 within the annular slot 152, the protrusion 150 travels within the limits of the slot 152 as the end surfaces 146 limit pivotal or angular movement to the range defined by the arcuate region 152' and the shaft 140 is fixed from upward or downward travel by the guide surfaces 160. In the example configuration, the protrusion 150 is a roll pin responsive to radial compression for reducing a diameter sufficient for insertion into an aperture 155 in the shaft 140. Alternatively, any suitable projection adapted to slidably traverse the annular slot 152 and rotate with the shaft may be employed.

The sleeve 142 forms a continuous structure around the annular slot 152, such that the shaft 140 is configured to receive the roll pin through the annular slot 152 while disposed in the bore 144. Therefore, the sleeve 142 and shaft 140 are configured for insertion of the roll pin into the aperture in the shaft following engagement of the shaft 140 into the bore of the sleeve 142, further defined by insertion axis 158. The aperture 155 is adapted to receive the roll pin through the annular slot 152, such that the roll pin or other protrusion 150 implementation secures the shaft 140 in rotational communication with the sleeve 142 from interference with the guide surfaces 160. Otherwise, the shaft 140 could not be inserted due to interference with the sleeve 142. Alternatively, a removable or detachable section of the sleeve 142 could allow selective shaft 140 insertion.

As the tablet 110 may be supporting books or heavy objects, stability is provided by avoiding an excessive off-center outward swing of the tablet 110. Accordingly, the protrusion 150 is configured to limit the pivotal movement of the shaft 140 to maintain a center of gravity of a load on the tablet 110 within support of the pedestal base 142.

Figure 4:
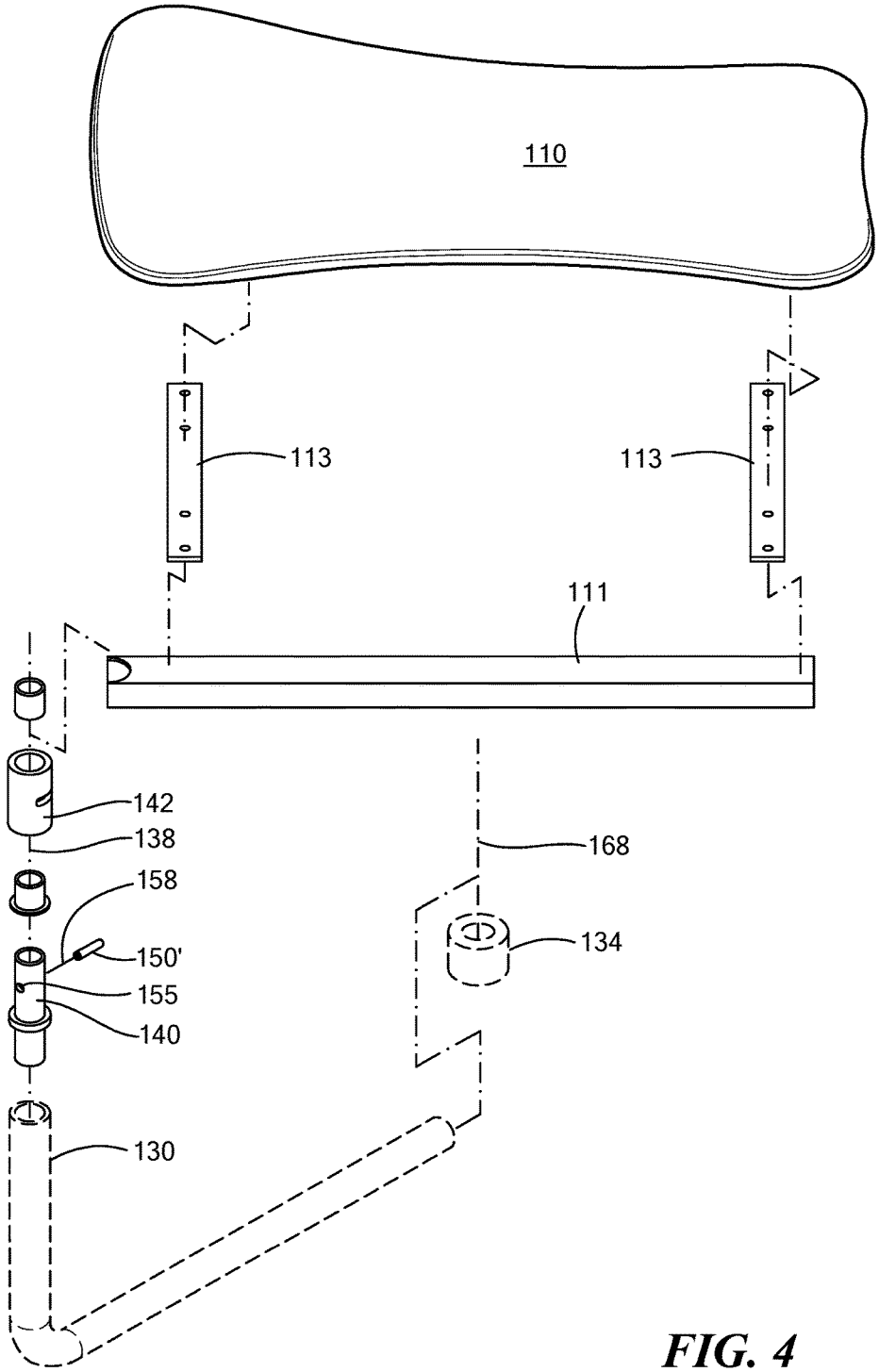
FIG. 4 shows an exploded view of the pivoting tablet of FIG. 1.

FIG. 4 shows an exploded view of the pivoting tablet of FIG. 1. Referring to FIGS. 1, 3C and 4, the shaft axis 138 is parallel to the axis 168 defining rotational movement of the swivel arm 130 via the collar 134. The shaft axis 138 is also perpendicular to the insertion axis 158 of the roll pin 150'. The collar 134 is disposed around the pedestal column 132. The swivel arm 130 is attached to the collar 134 adapted for rotation around the pedestal column 132 extending from the pedestal base 124, such that the pedestal base 124 is further configured for supporting a seating appliance in proximity to the tablet 110. The table frame 111 further includes one or more crossmembers 113 for providing support and rigidity to the tablet 110.

Figure 5:
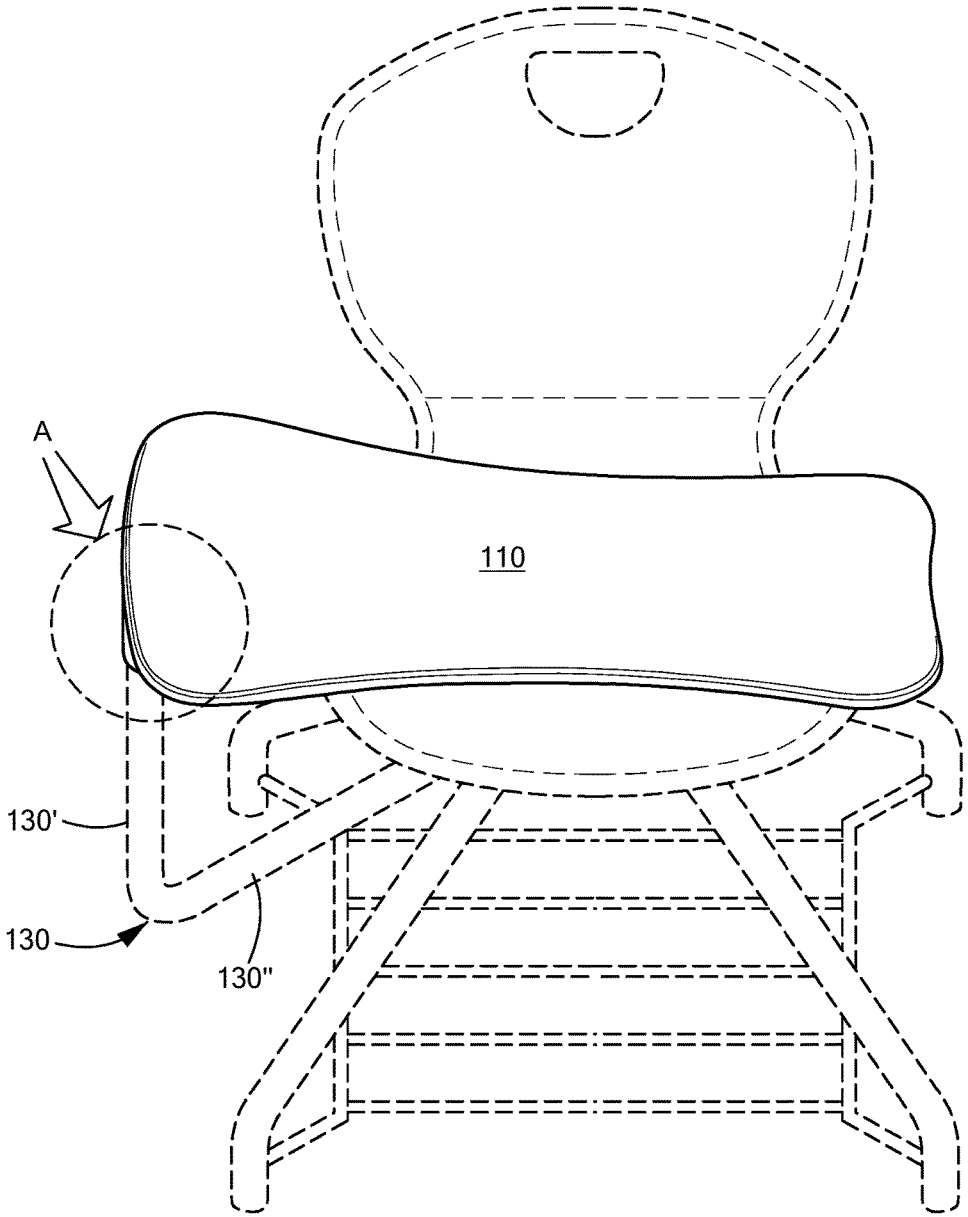
FIG. 5 shows the pivot assembly of the desk chair of FIG. 1.
Figure 5A:
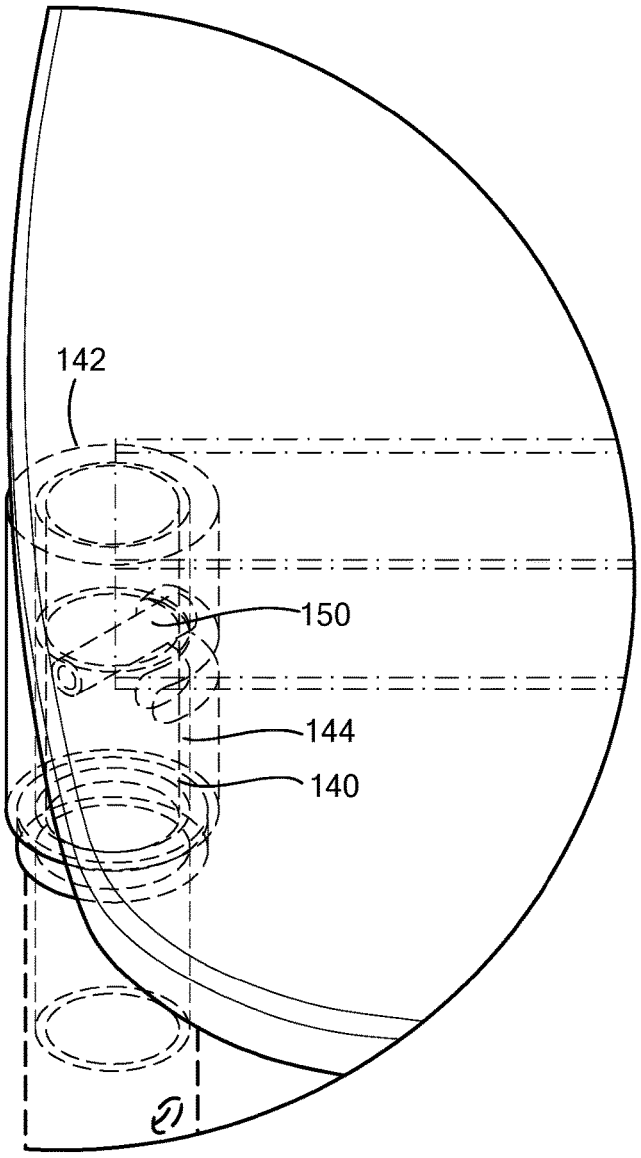
FIG. 5A shows a cutaway view of the detail area denoted A in FIG. 5.

FIG. 5 shows the pivot assembly of the desk chair of FIG. 1, and FIG. 5A shows a cutaway view of the detail area denoted A in FIG. 5. Referring to FIGS. 1, 5 and 5A, the swivel arm 130 has a vertical portion 130' supporting the sleeve 142 and a horizontal portion 130" attached to the collar 134. The sleeve 142 and the collar 134 are disposed at opposed ends of the swivel arm 130, such that the swivel arm has an "L" shaped bend for providing a perpendicular or normal orientation.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A moveable desk surface appliance, comprising:

a tablet on a pivoting support;

a shaft fixedly attached to the pivoting support, the shaft having a protrusion extending radially from an axis of the shaft;

a sleeve having a bore adapted to receive the shaft for rotation therein;

an annular slot in the sleeve configured to engage the protrusion, the annular slot having end walls for limiting movement of the shaft, the protrusion being a roll pin responsive to radial compression for reducing a diameter sufficient for insertion into an aperture in the shaft, the sleeve forming a continuous structure around the annular slot, the shaft configured to receive the roll pin through the annular slot while disposed in the bore; and a swivel arm attached to the sleeve, the swivel arm adapted for rotational movement relative to an attached pedestal base.

2. The device of claim 1 wherein the annular slot defines an arcuate region of the sleeve adapted to engage the protrusion for limiting pivotal movement of the shaft.

3. The device of claim 2 wherein the protrusion extends radially from and perpendicular to the shaft axis, the shaft axis defining pivotal movement of the tablet.

4. The device of claim 2 wherein the annular slot has opposed end surfaces defining the arcuate region, the pivotal movement limited by interference of the protrusion with the end surfaces.

5. The device of claim 4 wherein the annular slot has guide surfaces along a longer dimension of the arcuate slot, the guide surfaces configured for slideable engagement of the protrusion during pivoting of the shaft.

6. The device of claim 5 wherein the protrusion is configured to secure the shaft in rotational communication with the sleeve from interference with the guide surfaces.

7. The device of claim 1 wherein the shaft axis is parallel to an axis defining rotational movement of the swivel arm.

8. The device of claim 7 wherein the swivel arm is attached to a collar adapted for rotation around a pedestal column extending from the pedestal base, the pedestal base further configured for supporting a seating appliance in proximity to the tablet.

9. The device of claim 8 wherein the swivel arm has a vertical portion supporting the sleeve and a horizontal portion attached to the collar.

10. The device of claim 8 wherein the sleeve and the collar are disposed at opposed ends of the swivel arm, the swivel arm having an "L" shaped bend.

11. The device of claim 1 wherein the aperture is adapted to receive the roll pin through the annular slot, the roll pin securing the shaft in rotational communication with the sleeve from interference with the guide surfaces.

12. The device of claim 1 wherein the sleeve and shaft are configured for insertion of the roll pin into the aperture in the shaft following engagement of the shaft into the bore of the sleeve.

13. The device of claim 1 wherein the protrusion is configured to limit the pivotal movement of the shaft to maintain a center of gravity of a load on the tablet within support of the pedestal base.

14. A moveable desk surface appliance, comprising:

a tablet on a pivoting support;

a shaft fixedly attached to the pivoting support, the shaft having a protrusion extending radially from an axis of the shaft;

a sleeve having a bore adapted to receive the shaft for rotation therein;

an annular slot in the sleeve configured to engage the protrusion, the annular slot having end walls for limiting movement of the shaft, the sleeve forming a continuous structure around the annular slot such that the shaft is configured to receive the protrusion through the annular slot while disposed in the bore; and a swivel arm attached to the sleeve, the swivel arm adapted for rotational movement relative to an attached pedestal base.

15. A moveable desk surface appliance, comprising:

a tablet on a pivoting support;

a shaft fixedly attached to the pivoting support, the shaft having a protrusion extending radially from an axis of the shaft;

a sleeve having a bore adapted to receive the shaft for rotation therein;

an annular slot in the sleeve configured to engage the protrusion, the annular slot having end walls for limiting movement of the shaft, the annular slot defining an arcuate region of the sleeve adapted to engage the protrusion for limiting pivotal movement of the shaft wherein the annular slot has opposed end surfaces defining the arcuate region, the pivotal movement limited by interference of the protrusion with the end surfaces; and a swivel arm attached to the sleeve, the swivel arm adapted for rotational movement relative to an attached pedestal base.

* * * * *